US007465207B2

(12) United States Patent
Whitney

(10) Patent No.: US 7,465,207 B2
(45) Date of Patent: Dec. 16, 2008

(54) WEARABLE PERSONAL FLOATATION BOATING CUSHION APPARATUS

(76) Inventor: Bradley Whitney, 38 Fifield St., Nahua, NH (US) 03060

( * ) Notice: Subject to any disclaimer, the term of this patent is extended or adjusted under 35 U.S.C. 154(b) by 86 days.

(21) Appl. No.: 11/602,119

(22) Filed: Nov. 20, 2006

(65) Prior Publication Data

US 2007/0135005 A1 Jun. 14, 2007

Related U.S. Application Data

(60) Provisional application No. 60/750,097, filed on Dec. 14, 2005.

(51) Int. Cl.
*B63C 9/30* (2006.01)
*B63C 9/08* (2006.01)

(52) U.S. Cl. ..... 441/127; 441/106

(58) Field of Classification Search ..... 441/125–128, 441/106, 117, 118
See application file for complete search history.

(56) References Cited

U.S. PATENT DOCUMENTS

| | | | | |
|---|---|---|---|---|
| 3,366,984 | A * | 2/1968 | Blanc, Jr. | 441/118 |
| 3,371,363 | A * | 3/1968 | Blanc, Jr. | 441/118 |
| 3,727,249 | A * | 4/1973 | Bonthelius | 441/118 |
| 4,619,623 | A * | 10/1986 | Elverskog | 441/126 |
| 5,335,882 | A * | 8/1994 | Bonacci | 244/118.5 |
| 6,089,936 | A * | 7/2000 | Hoffman | 441/117 |
| 7,018,258 | B2 * | 3/2006 | McLarty | 441/97 |
| 2002/0068492 | A1 * | 6/2002 | Swanby et al. | 441/118 |

* cited by examiner

*Primary Examiner*—Jesus D Sotelo
(74) *Attorney, Agent, or Firm*—Lambert & Associates; Gary E. Lambert; Craig Dorais

(57) ABSTRACT

A life jacket which can be configured into various functional seat cushions for use on airplanes and boats. This life jacket contains one to three sections of various types of cushioning enclosed within water proof covers and connected by flexible hinges which allow the life jacket to be folded into various seat configurations. This life jacket also contains adjustable belts that can be used in the seat configurations or the life jacket configuration to fasten to the user.

12 Claims, 22 Drawing Sheets

WEARABLE PERSONAL FLOATATION BOATING CUSHION APPARATUS

CROSS-REFERENCE TO RELATED APPLICATIONS

This application claims the benefit of U.S. Provisional Application No. 60/750,097 filed on Dec. 14, 2005, the contents of which are incorporated herein by reference.

FIELD OF THE INVENTION

The present invention relates generally to the field of life jackets and more particularly to a combination life jacket and boat cushion.

BACKGROUND

The present invention includes many features not present in the prior art, including, but not limited to, the following:

1. a pop-up yoke plug;
2. the ability to fold or belt the present invention on to lifelines;
3. a middle fold on a life jacket to form a buoyant seat cushion;
4. double buckle belts, one in front and one in back, on a life jacket and a buoyant seat/back cushion;
5. self adhering, Velcro®, fold tabs;
6. a folded life jacket as a removable seat section of an upholstered lounge or bench seat or cockpit cushion;
7. life jacket/buoyant seat cushion with seat belt as a deck chair seat or helm seat;
8. life jacket folded as a buoyant airplane seat cushion with its own seat belt; and
9. slide rings allow belts to slide along retainer straps to adjust to different body contours when sitting and standing when used either as a seat or back cushion.

SUMMARY OF THE INVENTION

Boat cushions are put out first and taken in last. On the other hand, life jackets are rarely put out. As a result, if boat cushions double as life jackets, many drownings can be prevented. Further, it is a goal of the present invention to put a life jacket at the hand of every boater that will not wear one.

The wearable personal floatation boating cushion apparatus of the present invention can be put on while sitting, standing, or in the water. Just belt up, rotate it from back to front, free the fold tabs, put the yoke over your head, free and tie the yoke straps & snug front buckle. Typically the present invention can be a customary bright orange color material. In addition, it can be a decorative upholstered section of a lounge seat, bench, or cushion with orange on the inside folds which would be visible on the front when worn. The belt indicates it as a life jacket to belt on. Further, pictured instructions can be posted in an appropriate location on the boat. In addition, diagrams and instructions can be printed on the outer covering of the present invention, or on a flap which can be attached to the bottom of a cockpit cushion or deck pad or out of sight between the fold when the present invention is configured as a seat or back cushion or is attached to a lifeline.

The present invention has two belts with an adjustable buckle on the front and one on the back. The belts fasten around only the longer section of the seat visible to use—similar to an auto seat belt with no shoulder strap. There is a belt retainer strap running along the length of each outer side of the longer split section with two circular rings or loops that slide along each strap. The waist belt is knotted to the ring nearest the fold in the middle of the cushion. The other ring is to attach another belt as a chest belt. Or, an additional belt strap can be put through the extra slide ring in a manner that allows buckling the belts together on each side so the present invention can be belted over the lifelines for greater security during heavy weather. The yoke plug is hinged to secure it and allow it to pop up in either direction for the head to go through the yoke. If either side of the yoke is put over the persons head, the hinge and the area of the yoke plug where the hinge is located is designed with enough slack, or constructed of material such that the yoke plug would pop up either way. Further, the yoke plug is designed such that it stays in place when not in place over the user's head. This can be achieved by assorted methods such as (1) adding a padded hinge seam to hold the yoke plug in place while allowing for easy movement when necessary and maintaining a flush surface as a cushion; or (2) over-sizing the yoke plug to create a tight fit to hold the yoke plug in place while allowing for easy movement. Further, the yoke plug may be constructed of a different buoyant material. If the fold is at the bottom when standing, the life jacket will work but the yoke ties and the front buckle will be on the body side of the life jacket, rather than the outer side.

The present invention includes two versions: a Type I combination life jacket and buoyant boat cushion or a Type II combination life jacket and buoyant boat cushion.

The Type II personal floatation boating cushion is: (1) in contact when sitting, at arms reach when standing, and secured when belted on; (2) a portable buoyant cushion, a throw-able personal floatation device (PFD); a combination seat/back cushion; a space saver; (3) a removable matching cushion on a jump seat, convertible lounge seat, deck chair seat, helm seat, bench seat; (4) constantly available as a cushion when the boat is on a mooring with no perceived danger; (5) a removable airplane seat cushion/life jacket. When used as an airplane seat cushion the double buckled waist belt is secured by passing it through a belt loop (of similar material) in place of the belt slide rings. The belt may be folded over itself and clipped to itself with an s-clip on the belt. When the folded belt is removed from this clip and unbelted, it is long enough to wrap around the waist of an average size passenger. The belt retainer strap is stitched to the inner side of each longitudinal body section when the personal floatation boating cushion s folded into a seat cushion, (similar to how it is stitched on the bottom of the personal floatation boating cushion section of a full length cockpit cushion), rather than on the side so that it and the belt is on the inside of the folded section; out of sight and free from confusing passengers or catching on their clothing. There is a grab loop handle stitched to the bottom side of the airplane personal floatation boating cushion when it is used as a seat cushion, for passengers to grab and hold on to while they free the belt buckle, the fold tabs, put the yoke over their head, buckle the belt, tie the yoke tabs and then snug up the belt buckle on the front. Velcro® is used as the self adhering material for the fold tabs and the yoke tie strap. [Velcro® is the registered trademark of Velcro Industries, B.V.]

The following components are a part of the Type II version of the present invention: a waist and lifeline attachment belt, a chest or lifeline attachment belt, four belt buckles, two yoke straps with connective adhering material on one side of one end, two patches of connective adhering material on one side, four self adhering stitched on patches, two straps with a connective adhering patch on one end, four slide rings, two body sections, two chest sections, one yoke section, one yoke plug or flap, thread, and outer cloth covering material.

The Type I personal floatation boating cushion is similar in components and use to the Type II except it has the following: additional buoyancy material; stronger outer covering; added reflective tapes; stronger retainer straps and waist belt; slide rings; and double d-rings stitched on the waist belt on each side of the buckle at the front when it is worn as a life jacket.

The present invention will saves money and space by serving both as a buoyant cushion and life jacket. Further the Type II version of the present invention has more buoyancy support than a standard Type II Life Jacket or can be manufactured with thinner sections for equal buoyancy support.

The present invention can be an approved Type II life jacket for adults because it is made with the same material standards as any other standard type II life jacket, or if made with matching upholstered material, will function equally as an approved life jacket.

In addition, when the present invention is used in place of standard cushions, it should reduce liability and insurance expense. The present invention as a removable section of a cockpit cushion (or deck mat) have the retainer straps on the bottom out of sight, and use strapping material as belt loops instead of rings, to prevent possible scratching.

In addition, the present invention can be belted to lifelines on the fore decks to provide life jacket availability on the fore deck for boaters who do not wear life jackets. The prior art is not designed for this use or function.

A further advantage of the present invention is that "belting up" is now a customary habit. Unconnected waist belt buckles are a visible indication for the intended use of the present invention and present a "silent suggestion" to "buckle up." Further, "are your seat belts on?" is a common and acceptable phrase which needs no explanation. Many people would buckle up out of habit. If not buckled up and the weather suddenly threatened, one could buckle up themselves or their children without feeling intimidated by having to ask (or knowing enough to ask). Such intimidation can delay action, when an immediate and instinctive response is the best course of action. However, in compliance with boating regulations, under age children would still be required to wear an approved life jacket while on boats.

The present invention will help save the lives of boaters who want freedom from encumbrances, or are inexperienced in safety precautions. The present invention also helps overcome unpreparedness from human nature and complacency.

The present invention succeeds in saving space because the present invention is either: (1) part of a cushioned seat, (2) take the place of a portable cushion, (3) folded over or strapped to the life line, (4) in the cockpit (where they should be) as cushions and not in a locker, (5) folded over or belted on lifelines on the side deck, or fore deck. These are the likely locations for needed accessibility since people won't and don't wear life jackets. Most skippers do not even announce the location of life jackets to their guests, place them in sight, or give them a thought before getting under way—even when prudence dictates. Boating accidents happen without notice or preparation. All of a sudden there is confusion, yelling or injury and people in the water—possibly non-swimmers without a life jacket. No one wants to be forced to wear a lifejacket—many individuals believe this would destroy boating pleasure and the boating industry.

When optimally used, the present invention is an attached (i.e., belted on) folded life jacket that can be unfolded and put on in seconds at any time—in or out of the water. However, when not belted on, it is a folded floatation assist buoyant seat or back cushion at your finger tips, or at arms reach in the cockpit, which can be grabbed and used as a buoyant cushion or be unfolded to a life jacket and put on in seconds—in or out of the water.

DETAILED DESCRIPTION OF THE PREFERRED EMBODIMENTS

Figure 1:
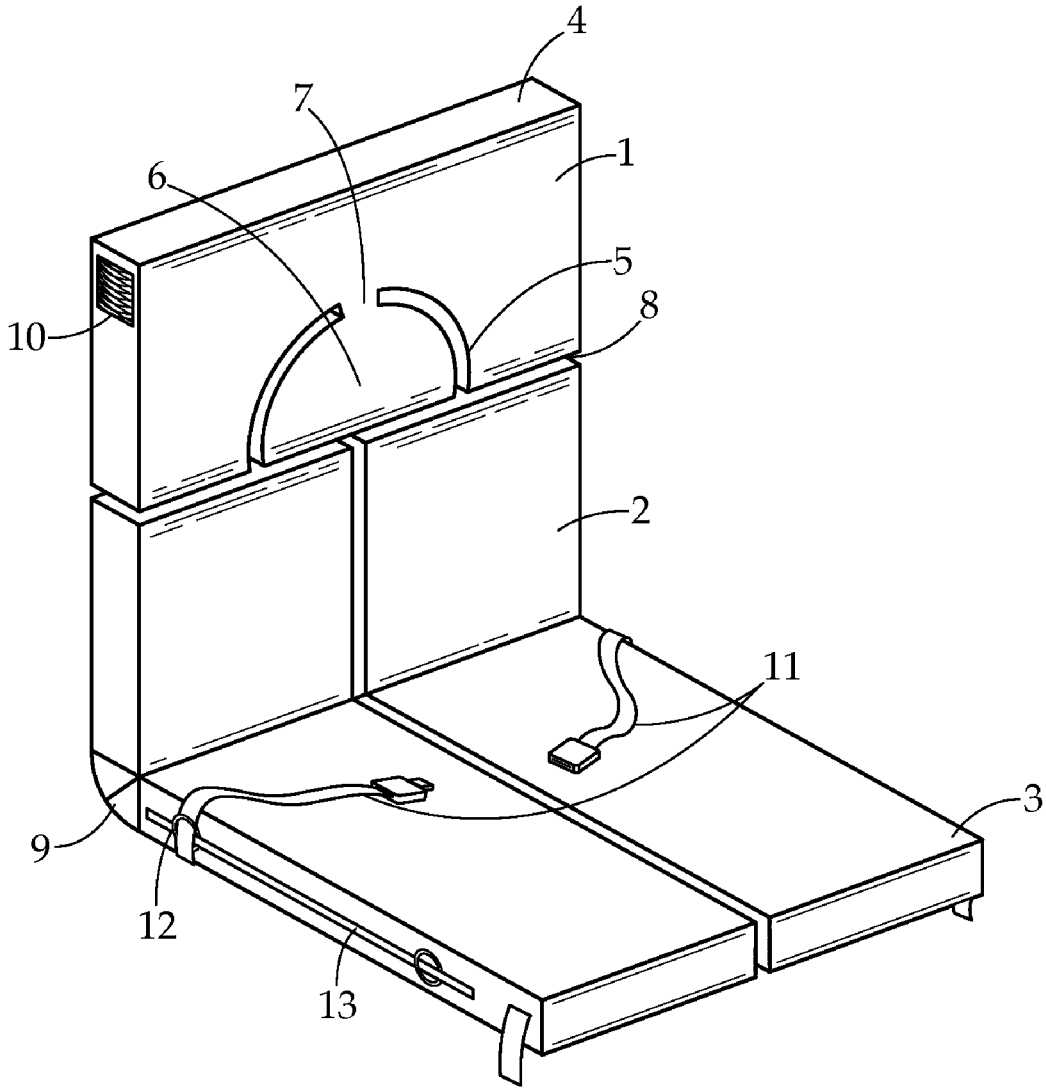
FIG. 1 is a view of the present invention in the open seat configuration.

FIG. 1 details an embodiment of the subject invention in the open seat configuration containing three separate Sections 1, 2, and 3, each containing a separate cushion enclosed in a water-proof cover 4. Section 1 is a yoke section which is located over the shoulders of a user once the personal floatation boating cushion is fastened to the user in the life jacket configuration. Section 2 is a chest section which is located near the chest of a user once the personal floatation boating cushion is fastened to the user in the life jacket configuration. Section 3 is a body section which is located near the lower body of a user once the personal floatation boating cushion is fastened to the user in the life jacket configuration. As illustrated in FIG. 1, Sections 1 and 2 are the backrest of the seat and Section 3 is the seated portion. In alternative embodiments of the subject invention, Sections 1, 2 and 3 are interchangeable as the backrest and seated portion of the open seat configuration of the personal floatation boating cushion. Section 1 contains an opening or yoke 5 through which a user's head is passed through when the personal floatation boating cushion is in the life jacket configuration. Section 1 further contains a yoke plug 6 in the yoke opening 5 when in the open seat configuration. This yoke plug 6 is connected to the edge of the yoke opening 5 on Section 1 by a hinge 7 which allows the yoke plug 6 to move in either direction out of the opening 5 away from Section 1 so as to allow a user's head to pass through the yoke opening 5 when the personal floatation boating cushion is in the life jacket configuration. FIG. 1 further shows Sections 1 and 2 attached to one another by a cloth hinge 8 to allow adequate movement of Sections 1 and 2 to allow a user's head to go through the yoke opening 5. FIG. 1 also shows a second hinge 9 which connects Sections 1 and 2 to Section 3 so as to allow Sections 1 and 2 to fold over and lie flat on either side of Section 3 in the closed configuration. This flexibility in the second hinge 9 allows the personal floatation boating cushion to be used in the open seat configuration as shown, to be used in the fully extended configuration to be used as a bench cushion, or to be folded onto itself to form to the closed configuration. The embodiment shown in FIG. 1 illustrates the use of Velcro® 10 on both sides of Section 1 and on both sides of Section 3 which allows the personal floatation boating cushion to be attached to a chair or bench in the open seat or fully extended configuration and also allows Sections 1 and 2 to attach to Section 3 when folded onto each other in the closed configuration. FIG. 1 further illustrates an adjustable buckle belt 11 attached to both ends of Section 3 to allow a user to be fastened to the personal floatation boating cushion when in the open seat configuration or the life jacket configuration. In an alternative embodiment of the subject invention, this belt may contain any means known in the art for connecting a belt. FIG. 1 also shows belt slide rings 12 and a belt retainer strap 13 which allow the buckle belt 11 to be adjusted to various user sizes in any configuration of the personal floatation boating cushion.

Figure 2:
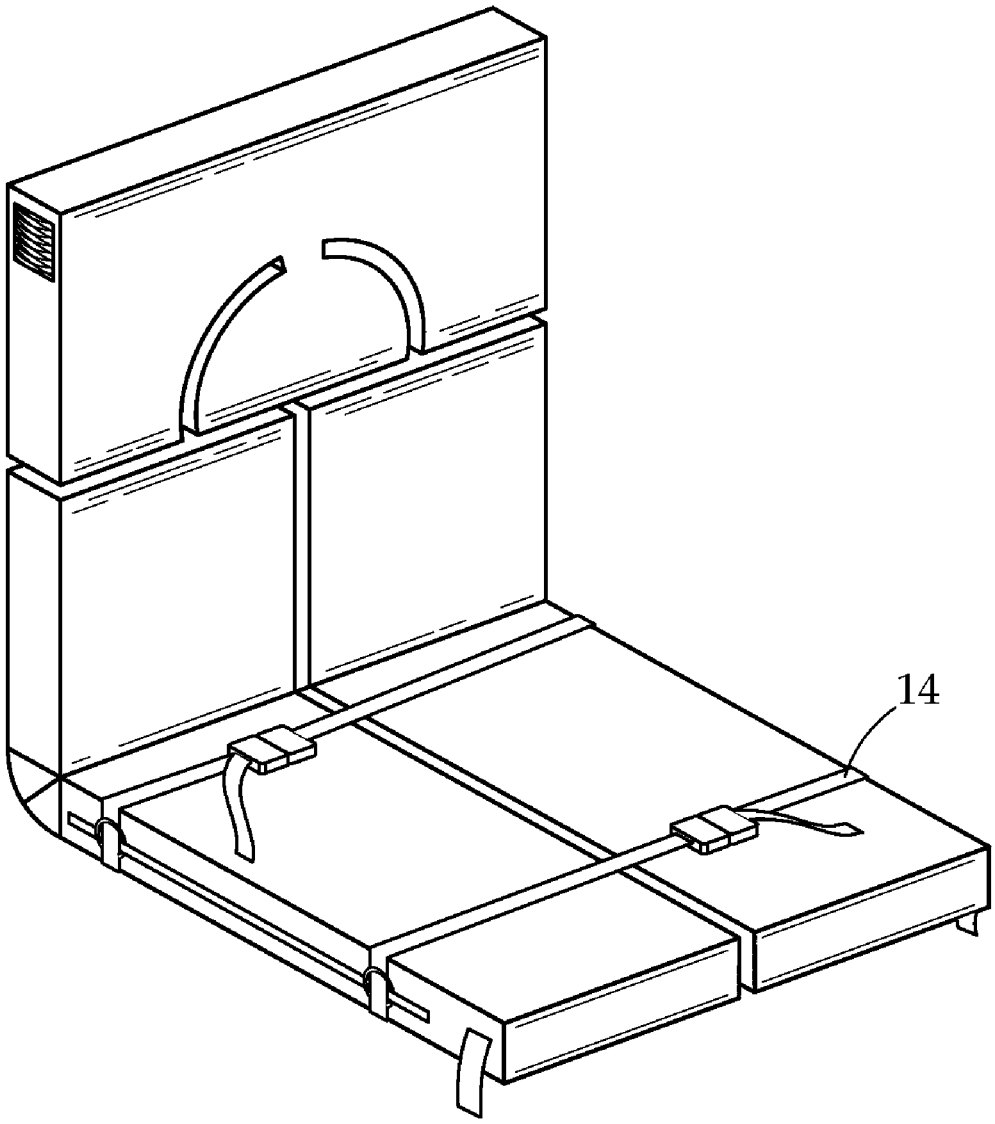
FIG. 2 is a view of the present invention in the open seat configuration, with two belts showing.

FIG. 2 illustrates an additional embodiment of the three section personal floatation boating cushion in the open seat configuration with an additional adjustable buckle belt 14.

Figure 3:
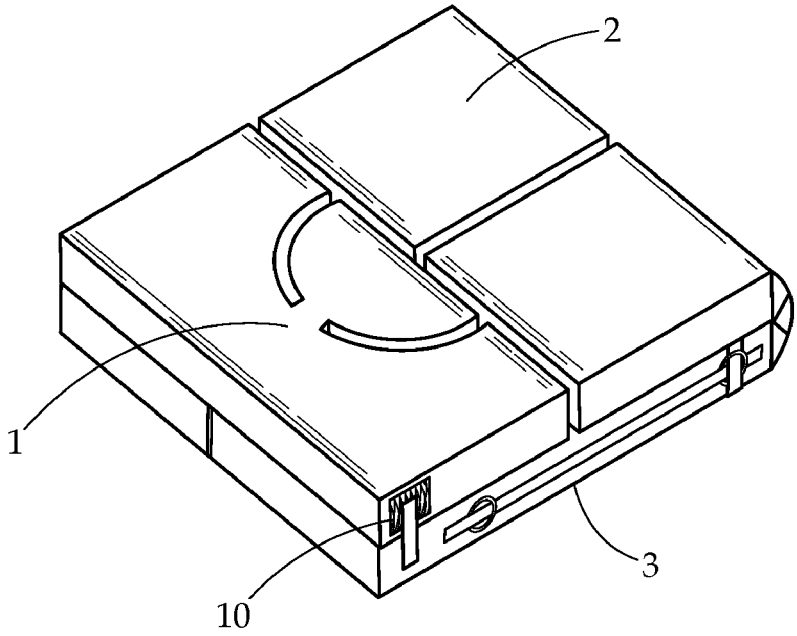
FIG. 3 is a top view of the present invention in the closed seat configuration.
Figure 4:
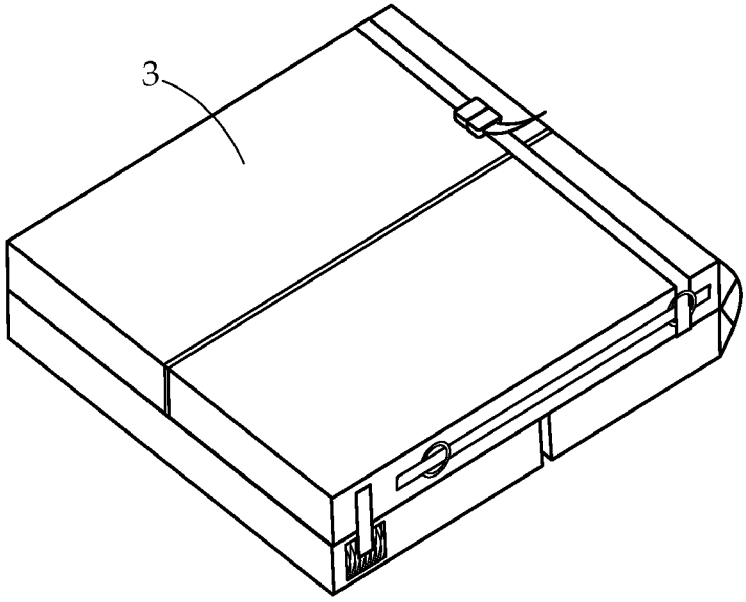
FIG. 4 is a bottom view of the present invention in the closed seat configuration.

FIG. 3 illustrates the top view of the three section personal floatation boating cushion in the closed configuration with Sections 1 and 2 folded onto Section 3 and attached to one another by the Velcro® 10. FIG. 4 details the bottom view of this closed configuration.

Figure 5:
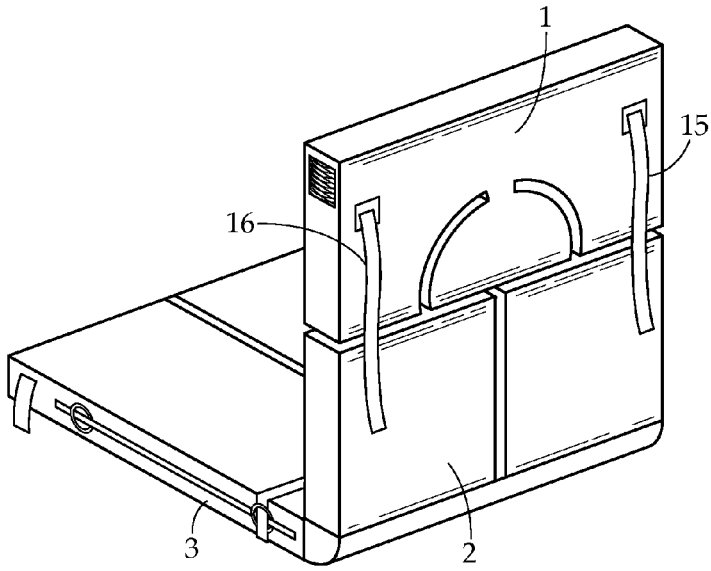
FIG. 5 is a side view of the present invention in the open seat configuration.
Figure 6:
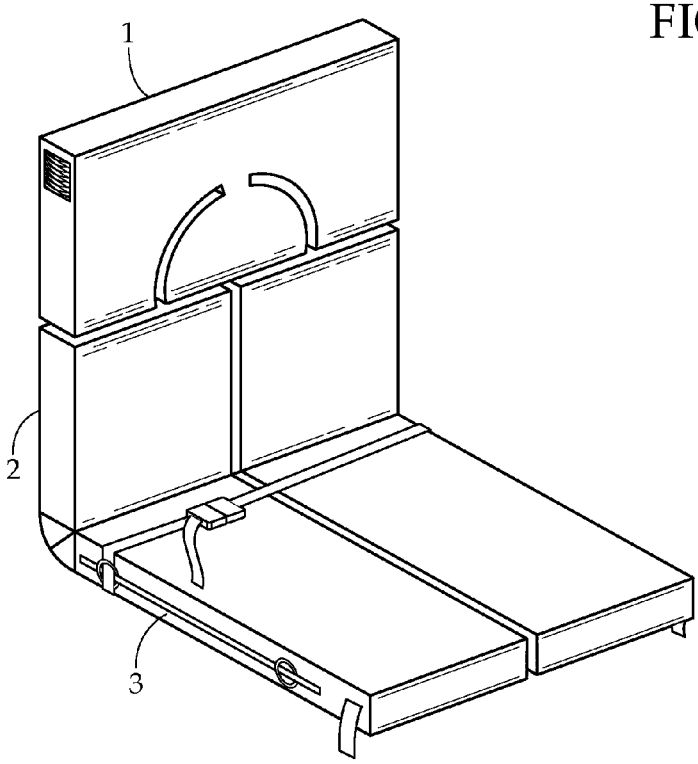
FIG. 6 is a side view of the present invention in the open seat configuration.

FIGS. 5 and 6 detail side views of the three section personal floatation boating cushion embodiment. FIG. 5 further details tie straps 15 and 16 which are attached to Sections 1 and 2 on either side of opening 5. Tie straps 15 and 16 are attached to the user when the personal floatation boating cushion is in the life jacket configuration.

Figure 7:
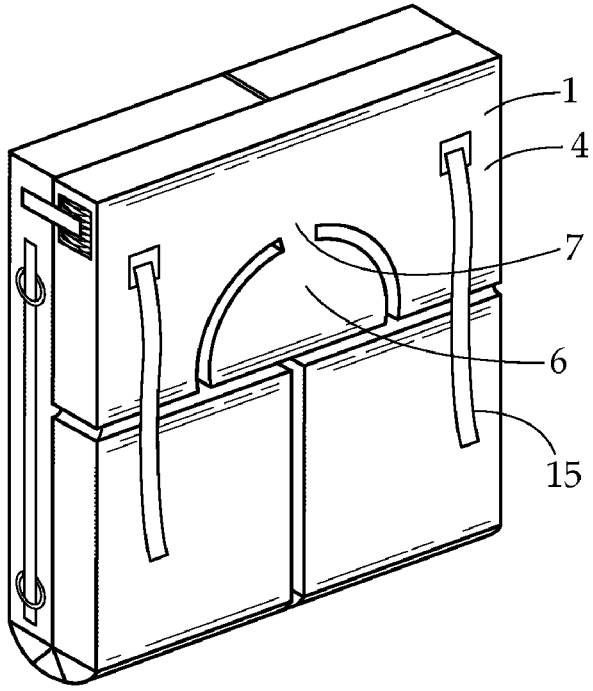
FIG. 7 is a top view of the present invention in the closed seat configuration depicting the yoke, yoke plug or flap, yoke hinge, and tie straps.
Figure 8:
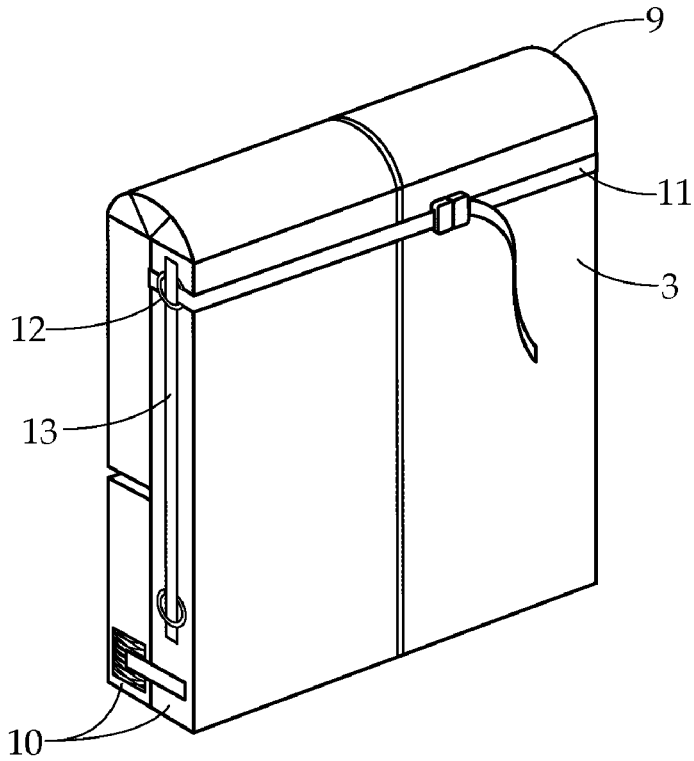
FIG. 8 is a bottom view of the present invention in the closed seat configuration depicting the middle fold hinge or other fastening means, waist belt with buckle, belt slide ring, belt retainer strap, and fold tab connecting patch.
Figure 9A:
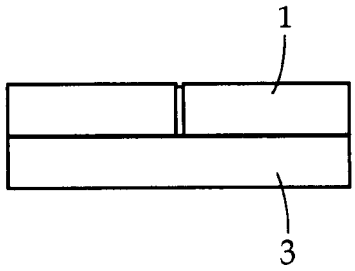
FIGS. 9*a*-9*f* are front, rear, left side, right side, top (front facing), and bottom (front facing) view of the present invention in the closed configuration.
Figure 9B:
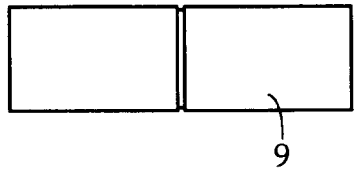

FIG. 7 details a bottom view of the three section personal floatation boating cushion embodiment in the closed configuration. FIG. 8 details a top view of the three section personal floatation boating cushion embodiment in the closed configuration. FIG. 8 details Section 3, the hinge 9, the Velcro® 10, the adjustable buckle belt 11, the belt slide rings 12 and the belt retainer strap 13 in the closed configuration. FIGS. 9*a*-9*f* also detail the three section personal floatation boating cushion embodiment in the closed configuration. FIG. 9*a* details Sections 1 and 3 in the front view of the closed configuration. FIG. 9*b* details the hinge 9 in the rear view of the closed configuration.

Figure 9C:
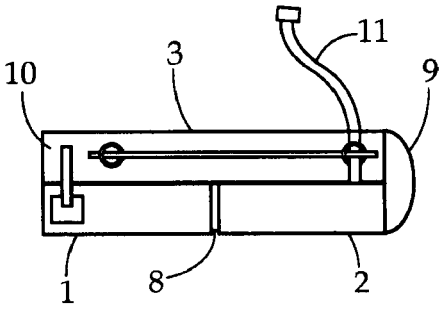
Figure 9D:
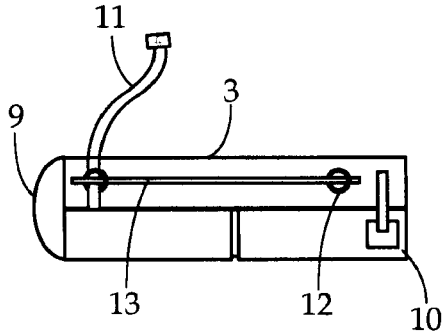
Figure 9E:
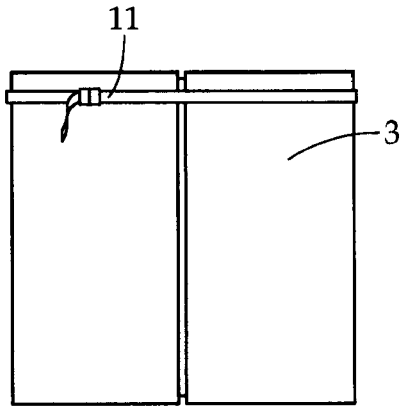
Figure 9F:
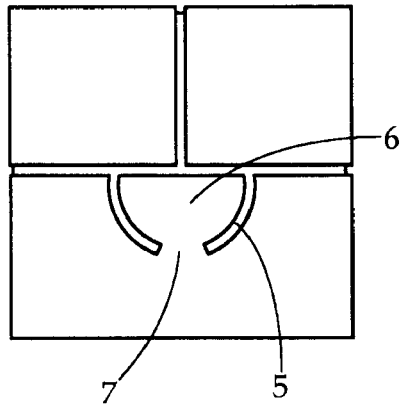

FIGS. 9*c* and 9*d* detail Sections 1, 2, 3; cloth hinge 8; second hinge 9; Velcro® 10; adjustable buckle belt 11, belt slide rings 12; and belt retainer strap 13 in the left side view and right side view, respectively, of the closed configuration. FIG. 9*e* details Section 3 and adjustable buckle belt 11 of the top view of the closed configuration. FIG. 9*f* details yoke opening 5; yoke plug 6; and hinge 7.

Figures 10A, 10B, 10C:
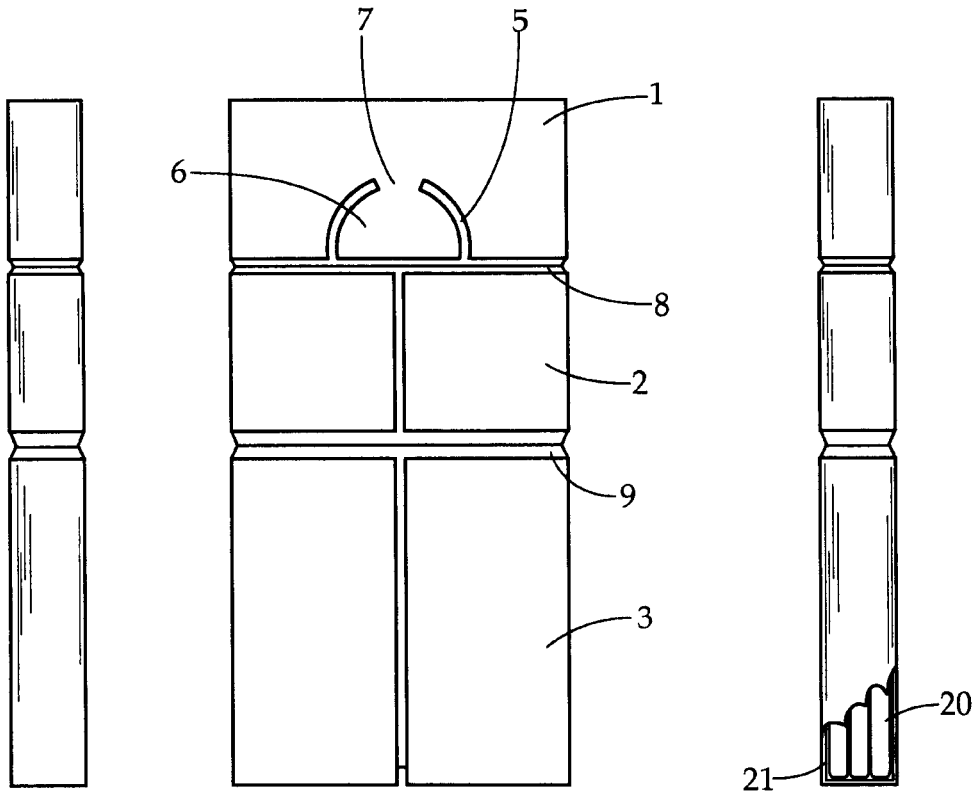
FIGS. 10*a* and 10*b* are side and top views of the present invention in the fully extended configuration.
FIG. 10*c* is a side view of the present invention with an internal view illustrating several pieces of internal buoyant material.

FIGS. 10*a* and 10*b* are side and top views, respectively, of the fully extended configuration of the personal floatation boating cushion detailing Sections 1, 2, and 3; yoke opening 5; yoke plug 6; hinge 7; cloth hinge 8; and second hinge 9.

FIG. 10*c* is a side view of the fully extended configuration additionally illustrating internal buoyant material 20 and an external layer 21 about said internal buoyant material.

Figure 11A:
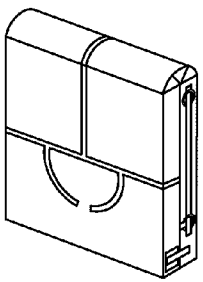
FIGS. 11*a*-11*j* are views of different belted embodiments of the present invention.
Figure 11B:
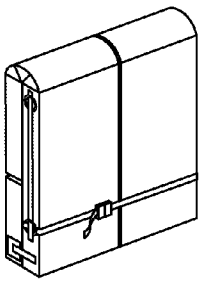
Figure 11C:
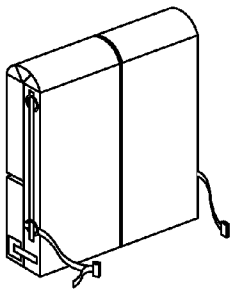
Figure 11D:
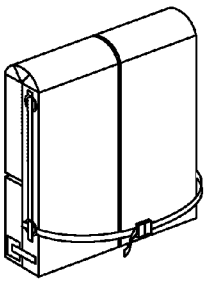
Figure 11E:
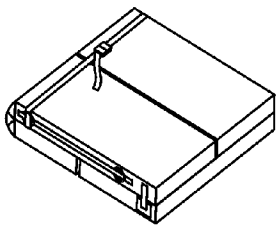
Figure 11F:
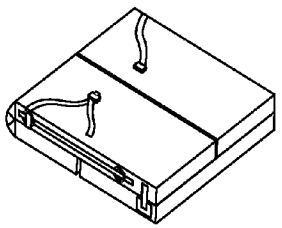
Figure 11G:
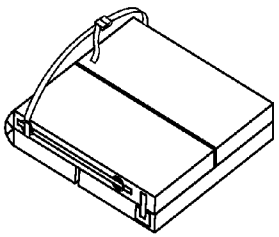
Figure 11H:
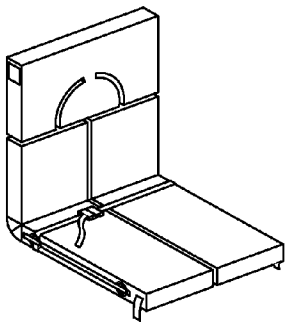
Figure 11I:
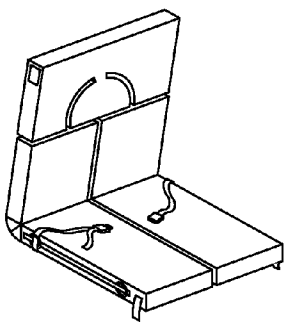
Figure 11J:
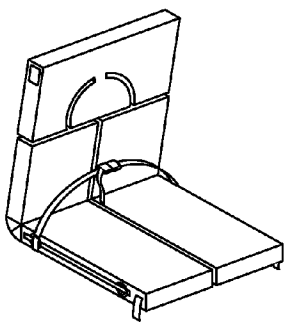

FIGS. 11*a*, 11*b* and 11*e* detail an embodiment of the closed configuration with the adjustable buckle belt 11 buckled. FIGS. 11*c* and 11*f* detail an embodiment of the closed configuration with the adjustable buckle belt 11 unbuckled. FIGS. 11*d* and 11*g* detail an embodiment of the closed configuration with the adjustable buckle belt 11 buckled on a user. FIG. 11*h* details an embodiment of the open seat configuration with the adjustable buckle belt 11 buckled. FIG. 11*i* details an embodiment of the open seat configuration with the adjustable buckle belt 11 unbuckled. FIG. 11*j* details an embodiment of the open seat configuration with the adjustable buckle belt 11 buckled on a user.

Figure 12A:
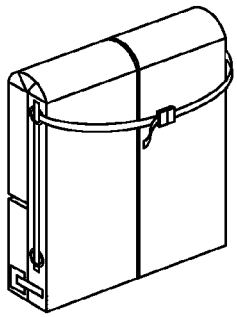
FIGS. 12*a*-12*m* are view depicting a method of using the present invention.
Figure 12B:
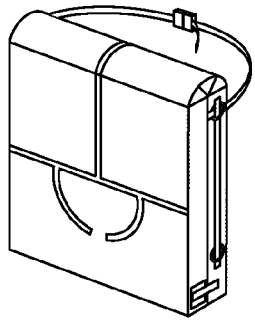
Figure 12C:
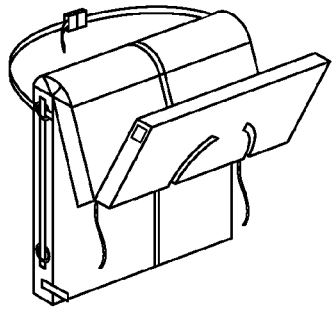
Figure 12D:
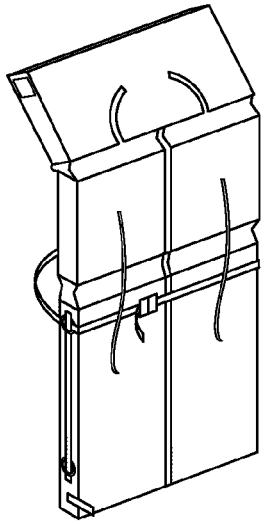
Figure 12E:
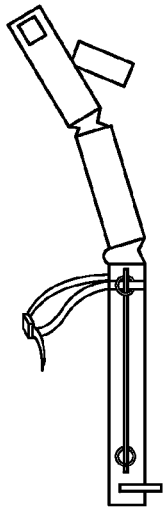
Figure 12F:
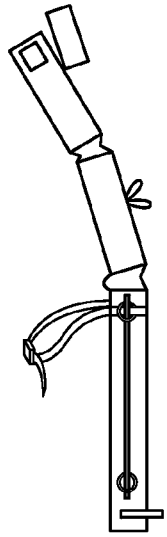
Figure 12G:
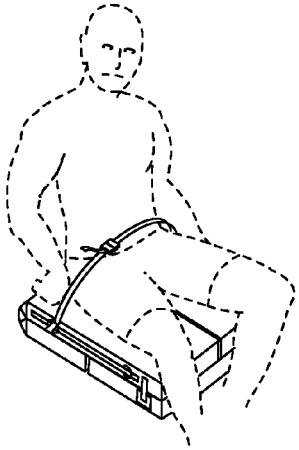
Figure 12H:
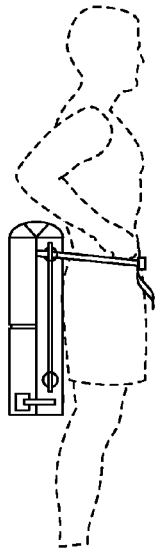
Figure 12I:
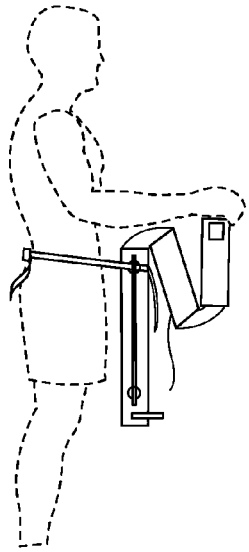
Figure 12J:
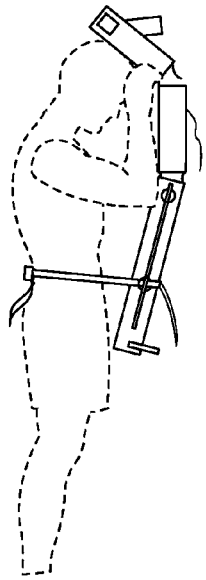
Figure 12K:
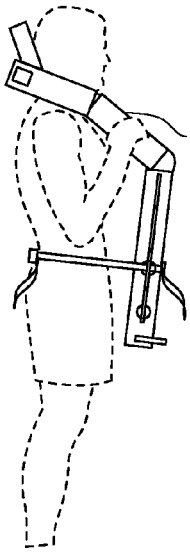
Figure 12L:
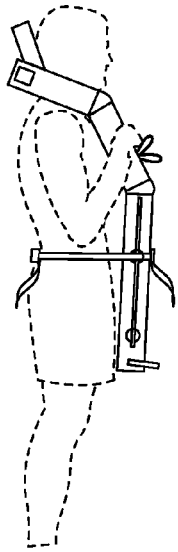
Figure 12M:
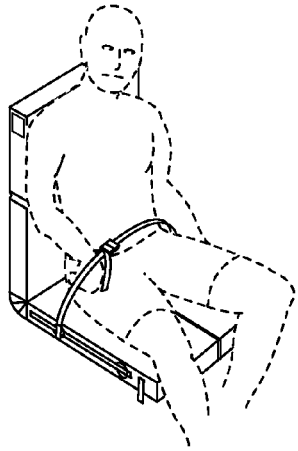
Figure 13A:
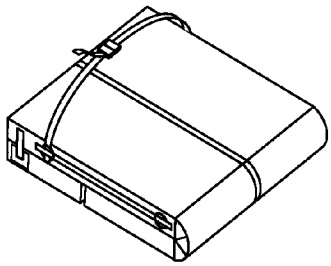
FIGS. 13*a*-13*m* are view depicting a method of using the present invention.
Figure 13B:
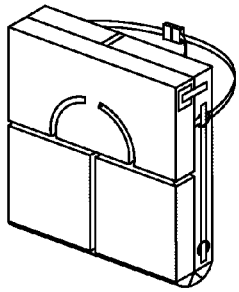
Figure 13C:
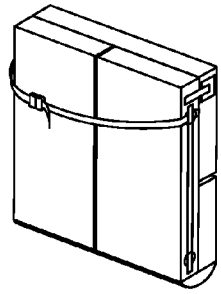
Figure 13D:
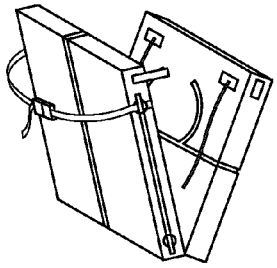
Figure 13E:
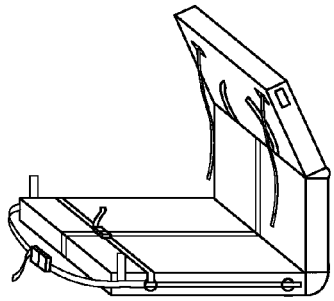
Figure 13F:
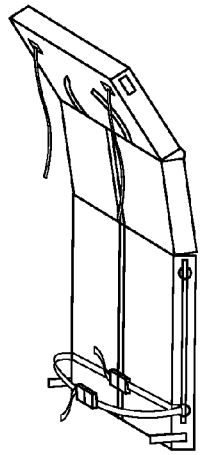
Figure 13G:
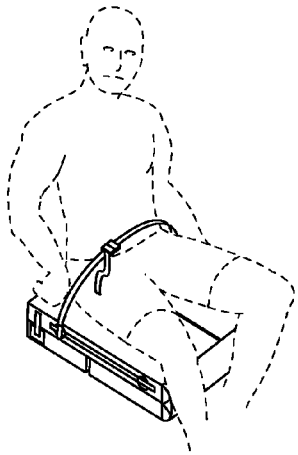
Figure 13H:
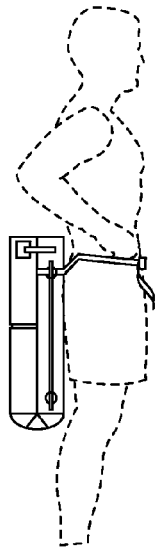
Figure 13I:
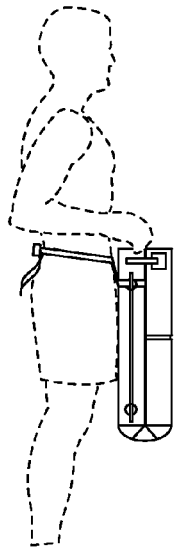
Figure 13J:
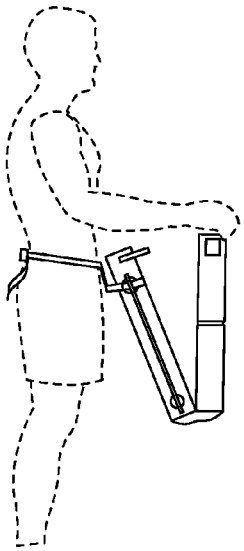
Figure 13K:
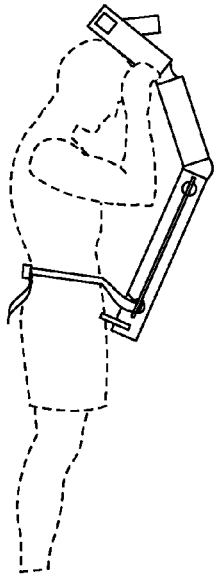
Figure 13L:
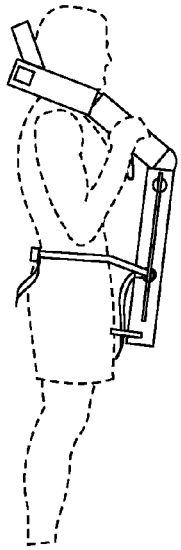
Figure 13M:
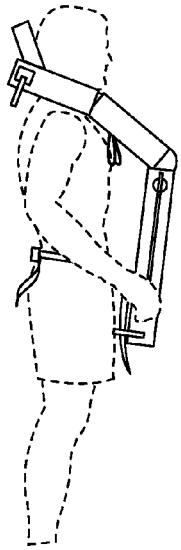

FIGS. 12*a*-12*m* detail an embodiment of converting the personal floatation boating cushion from the open seat or closed configuration to the life jacket configuration and placing it on a user. FIGS. 12*a* and 12*b* detail the closed configuration with the adjustable buckle belt 11 buckled. FIG. 12*c* details the movement of Sections 1 and 2 away from Section 3. FIGS. 12*d*-12*f* detail the fully extended configuration of the personal floatation boating cushion. FIG. 12*g* details a user sitting on and buckled onto the personal floatation boating cushion in the closed configuration. FIG. 12*m* details a user sitting on and buckled onto the personal floatation boating cushion in the open seat configuration. From the sitting positions detailed in FIGS. 12*g* and 12*m*, a user stands upright with the personal floatation boating cushion still buckled to the user with the adjustable buckle belt 11. In this upright position, the personal floatation boating cushion is located on the rear of the user. FIG. 12*i* details the next step for the user to rotate the buckled personal floatation boating cushion from the rear to the front of the user while still be fastened to the personal floatation boating cushion with the adjustable buckle belt 11. The user then lifts Sections 1 and 2 away from Section 3 on the second hinge 9 and pulls Section 1 towards his or her head. As detailed in FIG. 12*j*, the cloth hinge 8 allows Sections 1 and 2 to fold away from one another to allow Section 2 to rest flat on the chest of the user. The user then puts his or her head through the yoke opening 5 which caused the yoke plug 6 to move on hinge 7 out of the yoke opening 5 and allow the user's head to pass through the yoke opening 5. As detailed in FIGS. 12*k* and 12*l*, Section 1 comes to rest on the shoulders of the user, Section 2 rests on the chest of the user, and Section 3 rests on the body of the user to form the life jacket configuration. In alternative embodiments the user may fasten themselves to the life jacket with the additional buckle belt 14 and tie straps 15 and 16. FIGS. 13*a*-13*m* detail an additional embodiment of a user converting the personal floatation boating cushion from the closed configuration (used as a seat) to the life jacket configuration.

Figure 14B:
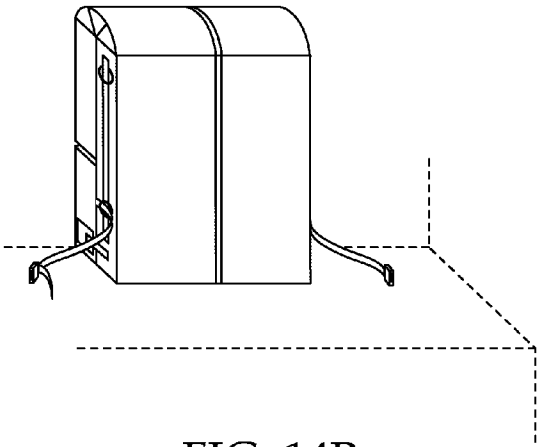
FIGS. 14*a*-14*e* are view depicting a method of using the present invention.
Figure 14A:
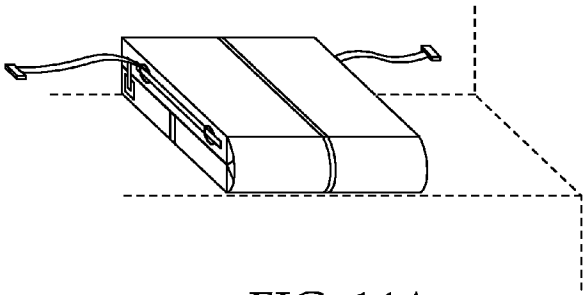

In additional embodiments of the subject invention, the personal floatation boating cushion may be used as cushion for any chair, seat or bench contained on a boat or ship, including, but not limited too a cushion for an upholstered lounge seat, a cockpit seat, a captains chair, and a deck chair. The subject invention may also be used as a cushion for any chair or seat contained on an airplane or as a cushion on portable objects that may be used as seats, including, but not limited to, ice coolers and portable chairs. FIG. 14*a* details an embodiment of the personal floatation boating cushion in the closed configuration as a seat cushion. FIG. 14*b* details an embodiment of the personal floatation boating cushion in the closed configuration as a back cushion.

Figure 14E:
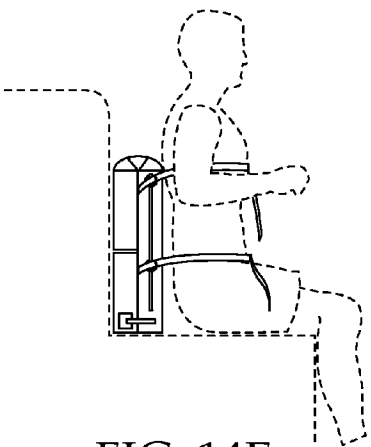
Figure 14D:
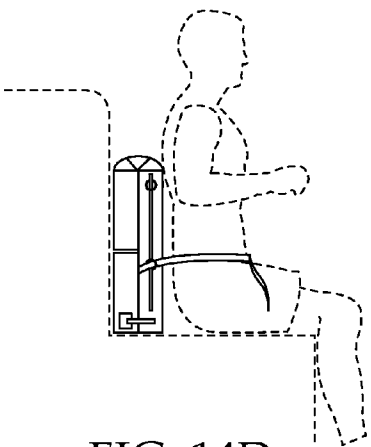
Figure 14C:
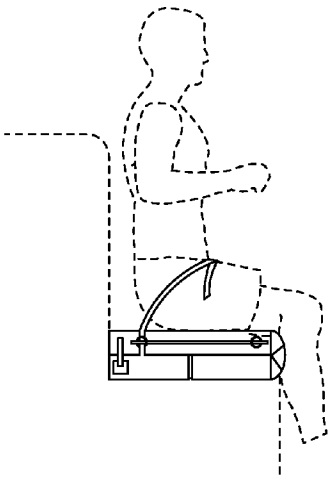
Figure 16A:
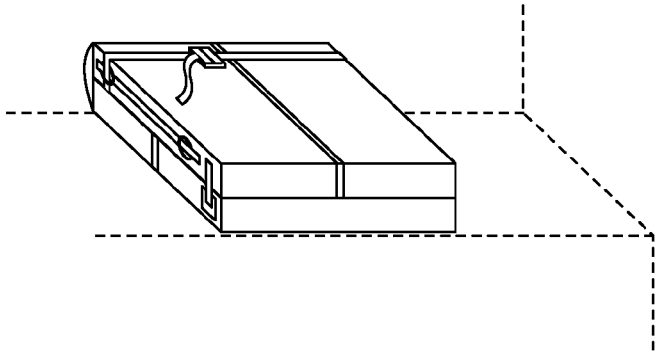
FIGS. 16*a* and 16*b* depict the present invention on a boat.
Figure 16B:
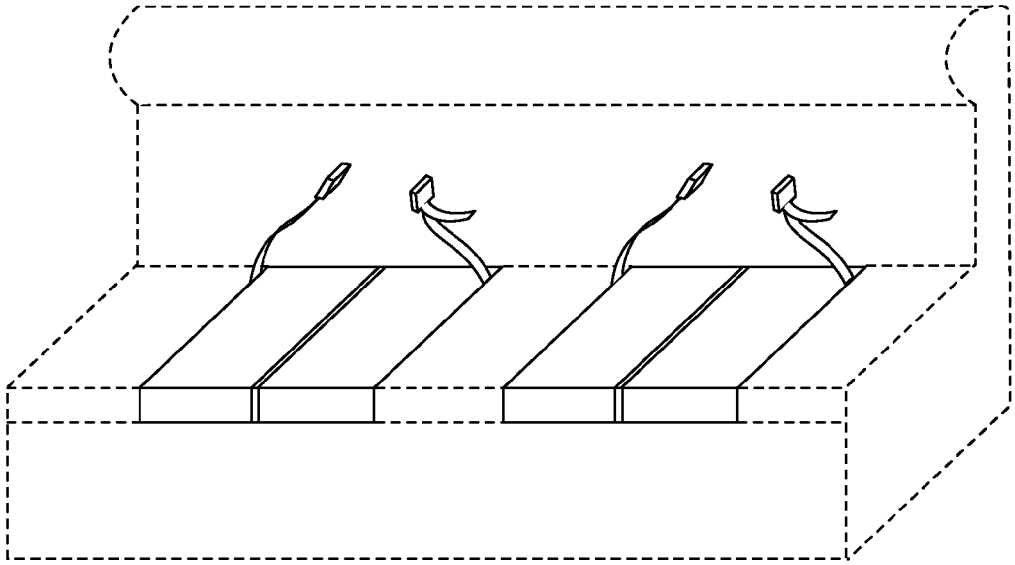

FIG. 14*c* details an embodiment of a user buckled into the personal floatation boating cushion in the closed configuration as a seat cushion. FIG. 14*d* details an embodiment of a user buckled into the personal floatation boating cushion in the closed configuration as a back cushion. FIG. 14*e* details an embodiment of a user fastened into the personal floatation boating cushion with two belts in the closed configuration as a back cushion for additional support in vigorous sailing or heavy weather. FIGS. 16*a* and 16*b* detail an additional embodiment of the personal floatation boating cushion in the closed configuration as a seat on a boat.

Figure 15A:
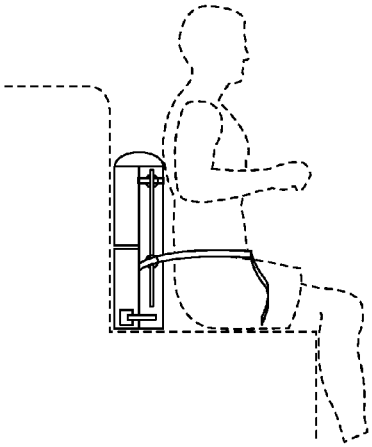
FIGS. 15*a*-15*n* are view depicting a method of using the present invention.
Figure 15B:
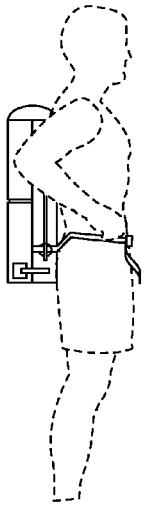
Figure 15C:
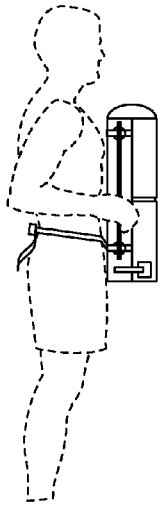
Figure 15D:
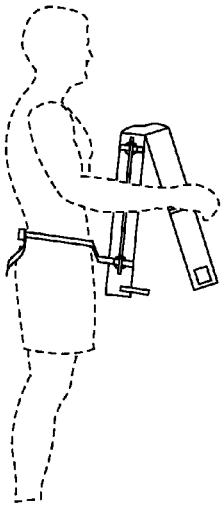
Figure 15E:
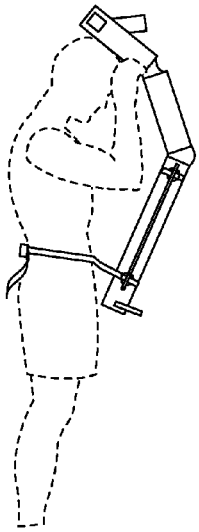
Figure 15F:
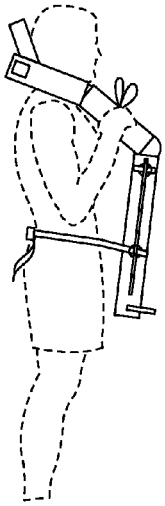
Figure 15G:
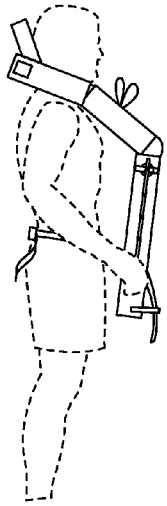
Figure 15H:
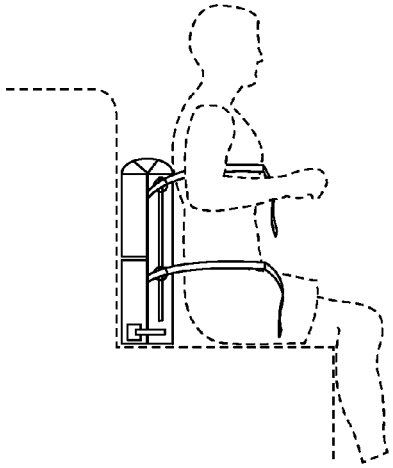
Figure 15I:
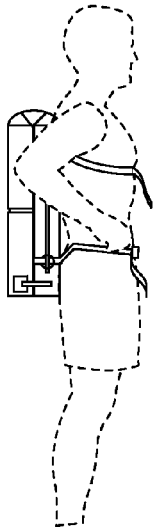
Figure 15J:
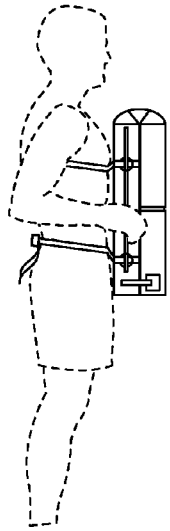
Figure 15K:
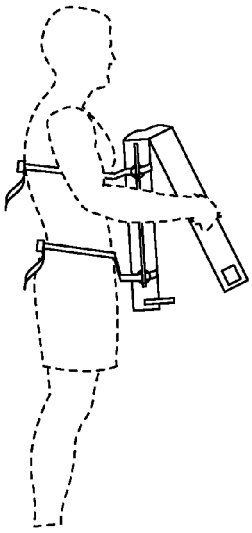
Figure 15L:
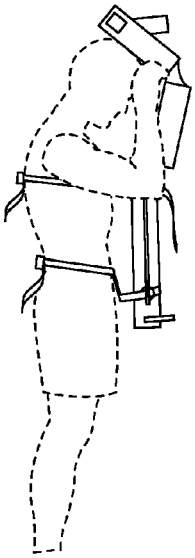
Figure 15M:
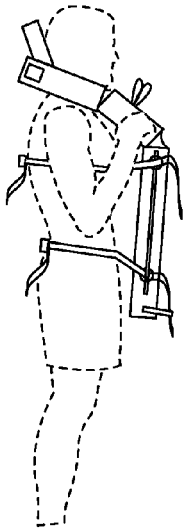
Figure 15N:
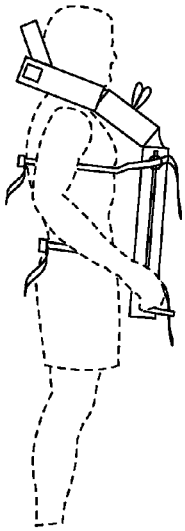

FIGS. 15*a*-15*n* detail an embodiment of a user converting the personal floatation boating cushion from the closed configuration being used as a single or double belted back rest to the life jacket configuration and placing it on themselves. From the sitting positions detailed in FIGS. 15*a* and 12*h*, a user stands upright, as shown in FIGS. 15*b* and 15*i*, with the personal floatation boating cushion still buckled to the user with the adjustable buckle belt 11 and optionally the additional adjustable buckle belt 14. In this upright position, the personal floatation boating cushion is located on the rear of the user. FIGS. 15*c* and 15*j* detail that the next step for the user is to rotate the buckled personal floatation boating cushion from the rear to the front of the user while still fastened to the personal floatation boating cushion with the adjustable buckle belt 11 and optionally the additional buckle belt 14. The user then lifts Sections 1 and 2 away from Section 3 on the second hinge 9 and pulls Section 1 towards his or her head as shown in FIGS. 15*d* and 15*k*. As detailed in FIGS. 15*e* and 15*l*, the cloth hinge 8 allows Sections 1 and 2 to fold away from one another to allow Section 2 to rest flat on the chest of the user. The user then puts his or her head through the yoke opening 5 which caused the yoke plug 6 to move on hinge 7 out of the yoke opening 5 and allow the user's head to pass through the yoke opening 5. As detailed in FIGS. 15*f*, 15*g*, 15*m* and 15*n*, Section 1 comes to rest on the shoulders of the user, Section 2 rests on the chest of the user, and Section 3 rests on the body of the user to form the life jacket configuration.

Figure 17A:
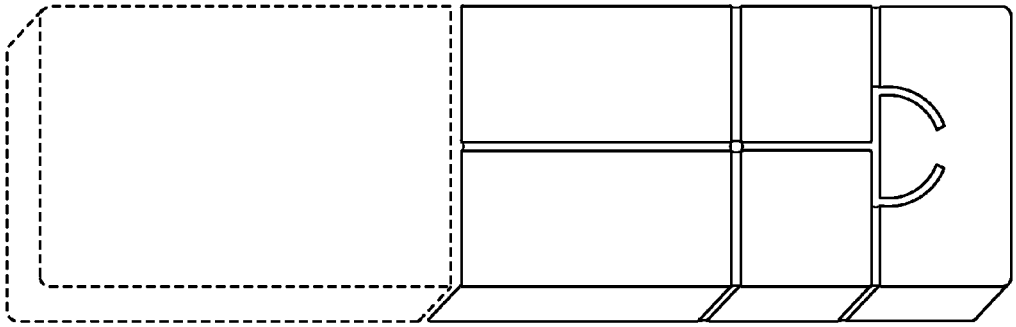
FIGS. 17*a*-17*c* depict the present invention as part of a cockpit cushion.
Figure 17B:
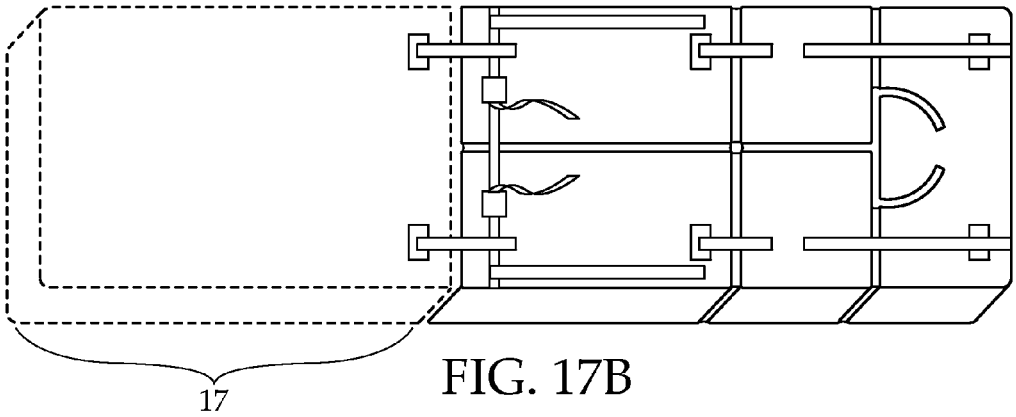
Figure 17C:
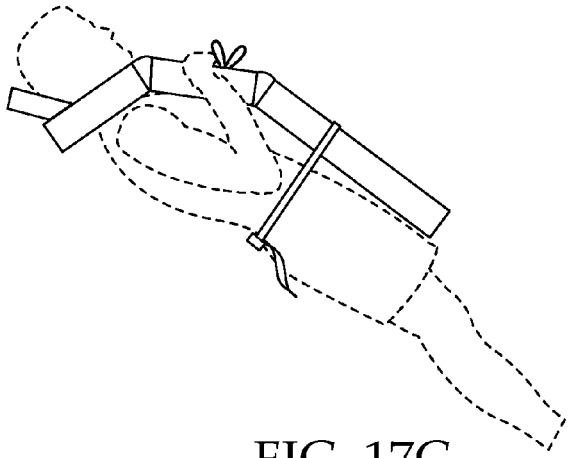

FIG. 17*a* details a top view of an embodiment of the personal floatation boating cushion in the fully extended configuration as a cockpit cushion. FIG. 17*b* details the bottom view of this embodiment. In this embodiment the personal floatation boating cushion contains an additional Section 17 which comprises an extra length cockpit cushion to be used as the cover seat. FIG. 17*c* details this embodiment of the personal floatation boating cushion in the life jacket configuration.

Figure 18A:
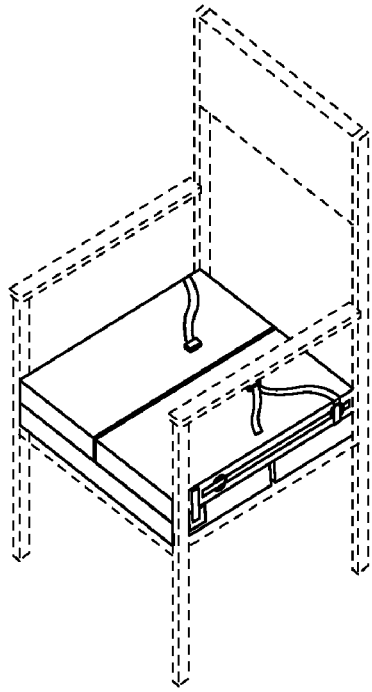
FIGS. 18*a* and 18*b* depict the present invention on a deck chair.
Figure 18B:
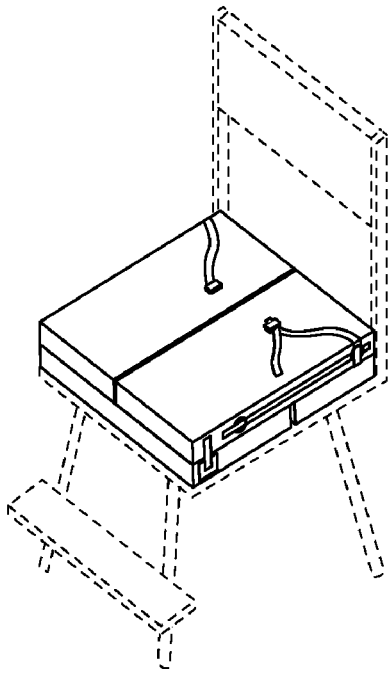
Figure 19A:
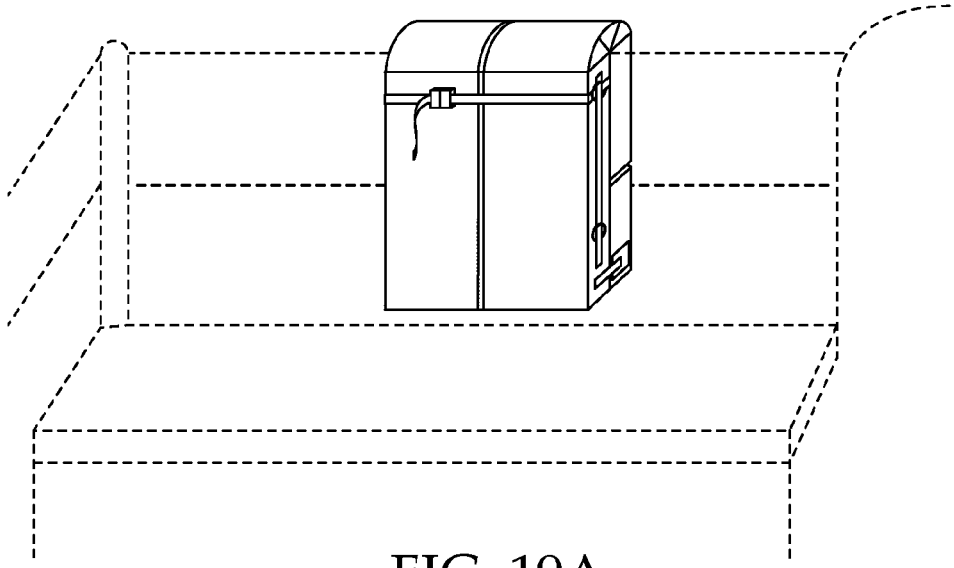
FIGS. 19*a* and 19*b* depict the present invention on a life line.
Figure 19B:
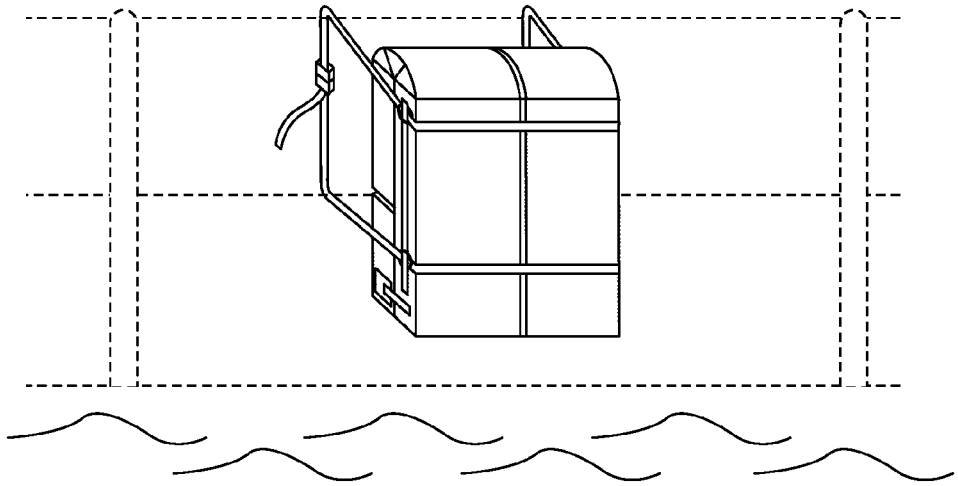

FIG. 18*a* details an embodiment of the personal floatation boating cushion in the closed configuration as the cushion on a deck chair. FIG. 18*b* details an embodiment of the personal floatation boating cushion in the closed configuration as the cushion on a stool chair. FIG. 19*a* details an embodiment of the personal floatation boating cushion in the closed configuration as the back cushion on the life line on a vessel. FIG. 19*b* details an embodiment of the personal floatation boating cushion in the closed configuration belted directed to the life line on a vessel.

Figure 20:
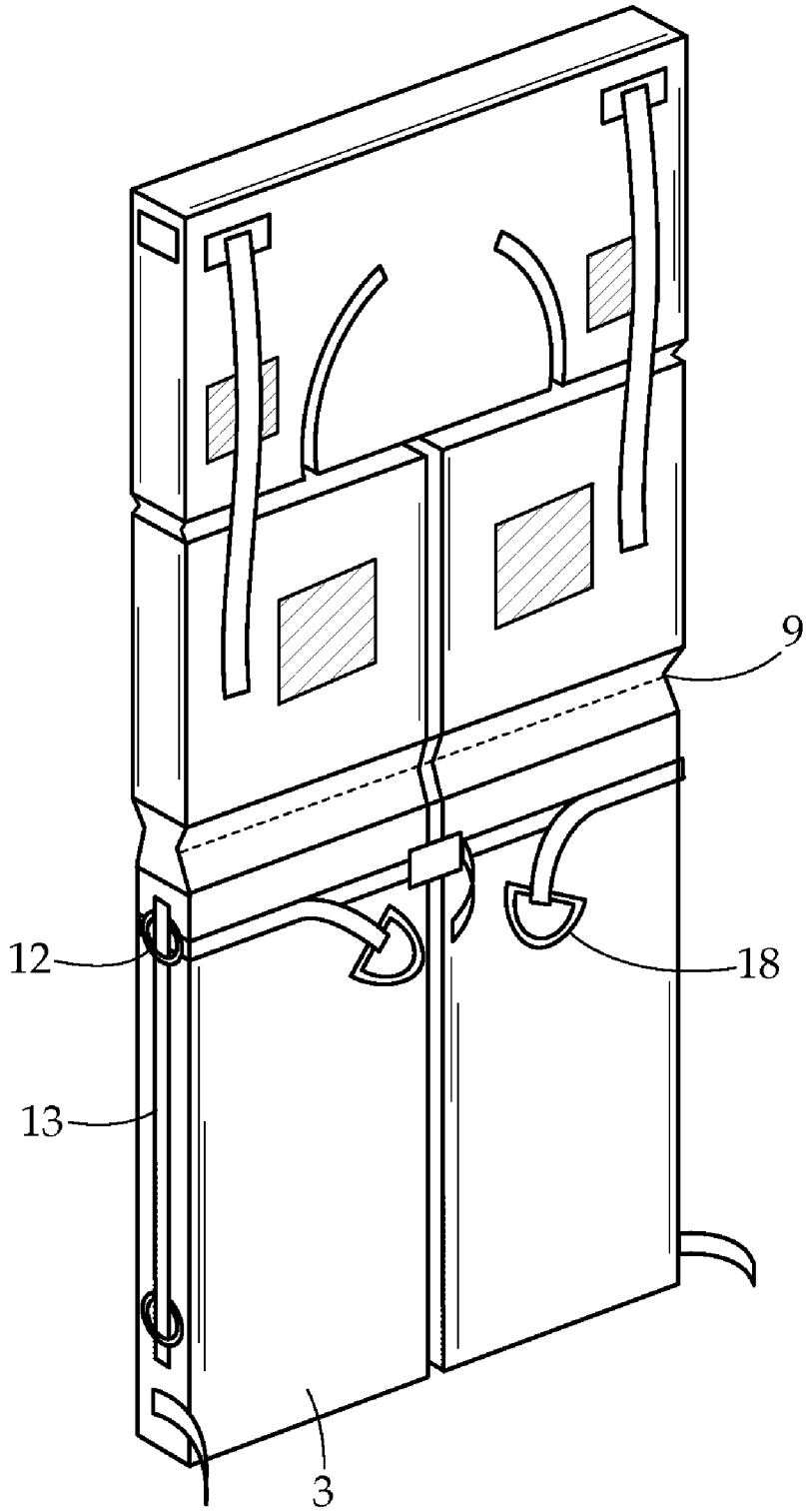
FIG. 20 depicts the Type I version of the present invention.
Figure 21A:
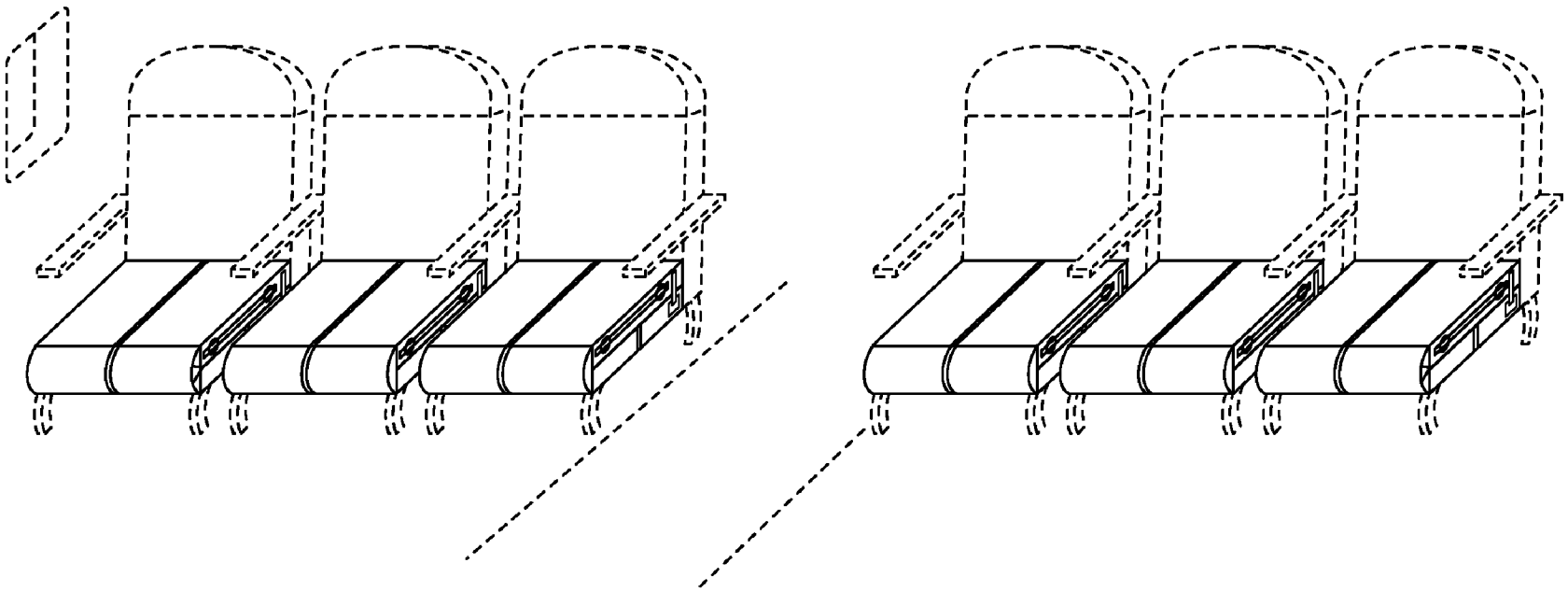
FIGS. 21*a*-21*d* depicts the present invention on an airplane.
Figure 21B:
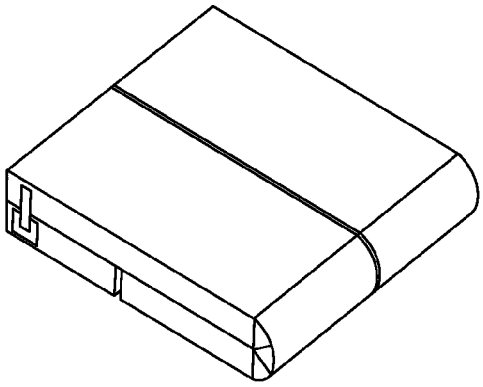
Figure 21C:
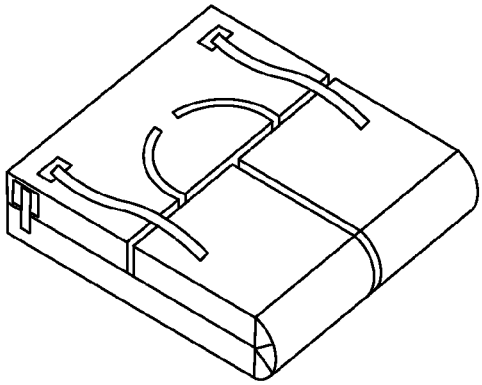
Figure 21D:
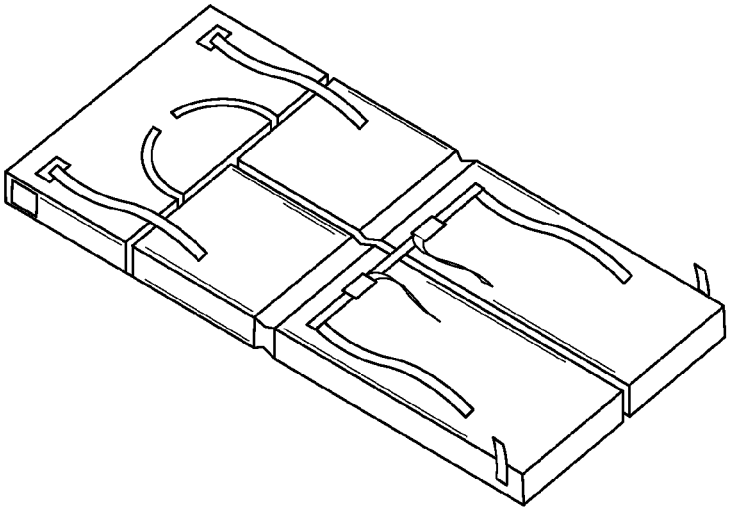

FIG. 20 details an additional embodiment of the subject invention. In this embodiment, the personal floatation boating cushion is stitched with UV resistant thread to avoid weakening of the personal floatation boating cushion stitching by sunlight exposure. In this embodiment the adjustable belt 11 comprises a wider harness and contains additional stainless steel D-rings 18 to allow a user to more tightly fasten oneself to the personal floatation boating cushion. In this embodiment, the belt slide rings 12 are composed of stainless steel. All buckles and rings of the subject invention may be made of stainless steel or another non-corrosive metal as known to those skilled in the art.

FIGS. 21*a*-21*d* detail an embodiment of the personal floatation boating cushion in the closed configuration as an airplane seat.

In additional embodiments of the subject invention, in order to make the personal floatation boating cushion more comfortable, flexible or softer, the buoyancy material for each cushion of the personal floatation boating cushion can be in a single shaped piece, several thin sheets, or very small pieces of foam or other material providing adequate buoyancy. In a further embodiment of the subject invention, an outward layer of softer foam cushion inside the water proof cover could be added to the personal floatation boating cushion. In additional embodiments of the subject invention, the thickness of the outer-covering of the personal floatation boating cushion may be greater to accommodate thicker or denser cushion foam.

In additional embodiments of the subject invention, the personal floatation boating cushion may be manufactured with one; two or three separate body sections connected by hinges with no cushioning that allow these sections to fold over onto one another. A one piece body section will help prevent against wear at the seams of the hinges. A one piece body section will also eliminate any tendency for the hinges to spread apart from the pressure of the users on the cushions while the personal floatation boating cushion is in use as a seat or back cushion.

In further embodiments of the subject invention, each of the buckle belts may contain two separate buckles or double buckles such that when a user belts onto the open seat or closed configuration of the personal floatation boating cushion, there is a buckle on the front of the user, and when the personal floatation boating cushion is rotated from the rear of the user to the front of the user to form the life jacket configuration, there is a second buckle on the same belt which is now on the front of the user to allow the user to adjust the life jacket configuration of the personal floatation boating cushion.

The cushions of the subject invention may be in various shapes and sizes, including, but not limited to squares, rectangles, triangles, circles, tetragons, pentagons, hexagons, Heptagons and octagons and virtually any other shape.

In another embodiment of the subject invention, additional safety or location indicators may be attached to the personal floatation boating cushion, including, but not limited to a whistle, strobe light, cartridge inflated helium balloon location device, antenna signal locator device, or a cell or satellite emergency locator device.

Although the present invention has been described with reference to particular embodiments, it will be apparent to those skilled in the art that variations and modifications can be substituted therefore without departing from the principles and spirit of the invention.

What is claimed:

1. A life jacket comprising a. a first section comprising a first buoyant cushion enclosed within a first water-proof cover wherein the first buoyant cushion further comprises an opening large enough to allow the head of a user to pass through the first buoyant cushion;

b. a plug for the opening of the first buoyant cushion wherein a first end of the plug is connected to the opening edge on the first buoyant cushion by a first hinge which allows a second end of the plug to move in either direction away from the first buoyant cushion through the opening;

c. a second section comprising a second buoyant cushion enclosed within a second water proof cover;

d. a second hinge connecting a first end of the first buoyant cushion to a first end of the second buoyant cushion which allows the first buoyant cushion to be folded onto a first side or a second side of the second buoyant cushion;

e. a first strap and a second strap connected to a first side of the first buoyant cushion on opposite sides of the opening and further connected to the first side of the second buoyant cushion, wherein the first strap and the second strap allow the user to be fastened to the first buoyant cushion and the second buoyant cushion;

f. a third section comprising a third buoyant cushion enclosed within a third water proof cover;

g. a third hinge connecting a second end of the second buoyant cushion to a first end of the third buoyant cushion which allows the first buoyant cushion and the second buoyant cushion to be folded onto a first side or a second side of the third buoyant cushion;

h. a first adjustable buckle belt on the first side of the third buoyant cushion;

i. a second adjustable buckle belt on the second side of the third buoyant cushion, wherein the first adjustable buckle belt and the second adjustable buckle belt each fasten around the first side of the third buoyant cushion, further wherein the user may be fastened to the third buoyant cushion with the first adjustable buckle belt and the second adjustable buckle belt;

j. means for adjusting the first adjustable buckle belt and the second adjustable buckle belt so as to allow various size users to be fastened to the third buoyant cushion;

k. means for attaching the first buoyant cushion and the second buoyant cushion to the first side of the third buoyant cushion when folded onto the first side of the third buoyant cushion;

l. means for attaching the first buoyant cushion and the second buoyant cushion to the second side of the third buoyant cushion when folded onto the second side of the third buoyant cushion; and m. means for attaching the life jacket to a seat frame.

2. The life jacket of claim 1 wherein any one of the first, second or third water proof covers is reflective.

3. The life jacket of claim 1 wherein the first buoyant cushion comprises a single piece of buoyant material.

4. The life jacket of claim 1, wherein the first buoyant cushion comprises several pieces of buoyant material.

5. The life jacket of claim 1 wherein the second buoyant cushion comprises a single piece of buoyant material.

6. The life jacket of claim 1, wherein the second buoyant cushion comprises several pieces of buoyant material.

7. The life jacket of claim 1 wherein the third buoyant cushion comprises a single piece of buoyant material.

8. The life jacket of claim 1, wherein the third buoyant cushion comprises several pieces of buoyant material.

9. The life jacket of claim 1, wherein the user can wear the life jacket while sitting, standing, or in the water.

10. The life jacket of claim 1 wherein the third buoyant cushion comprises an additional external layer of softer cushioning.

11. The life jacket of claim 1, wherein the first adjustable buckle belt comprises an indicator that it is a life jacket.

12. The life jacket of claim 1, further comprising pictured instructions.

* * * * *